US008721111B2

(12) United States Patent
Yeh

(10) Patent No.: US 8,721,111 B2
(45) Date of Patent: May 13, 2014

(54) FLASHLIGHT ZOOMING STRUCTURE

(75) Inventor: Hsueh-Chu Yeh, Tainan (TW)

(73) Assignee: Shih-Hao Wang, Tainan (TW)

( * ) Notice: Subject to any disclaimer, the term of this patent is extended or adjusted under 35 U.S.C. 154(b) by 354 days.

(21) Appl. No.: 13/326,420

(22) Filed: Dec. 15, 2011

(65) Prior Publication Data

US 2013/0155666 A1 Jun. 20, 2013

(51) Int. Cl.
*F21L 4/00* (2006.01)

(52) U.S. Cl.
USPC ..... 362/187; 362/196

(58) Field of Classification Search
CPC ..... F21L 4/027; F21L 4/04; F21V 14/065; F21V 14/06; F21V 21/145
USPC ..... 362/187, 196
See application file for complete search history.

(56) References Cited

U.S. PATENT DOCUMENTS

2010/0208371 A1* 8/2010 Chao ..... 359/824
2011/0080725 A1* 4/2011 Brands et al. ..... 362/187

* cited by examiner

*Primary Examiner* — Andrew Coughlin
(74) *Attorney, Agent, or Firm* — Alan Kamrath; Kamrath IP Lawfirm, P.A.

(57) ABSTRACT

A flashlight zooming structure includes a main body and a zooming assembly screwed on one end of a neck of the main body. In the zooming assembly, a transparent lamp cup centrally formed with a convex lens is received in a cup seat, the cup seat is screwed into a cap, and the lugs on the outer periphery of the cup seat are received in the corresponding peripheral notches of a receiving section extending from one end of a middle annular element. To illuminate a distant or nearby target, the zooming assembly mounted around the neck of the main body is rotated in the desired direction so that the light emitted by a lighting unit at one end of the neck of the main body is projected outward through the transparent lamp cup in the zooming assembly as a convergent or divergent light beam.

2 Claims, 6 Drawing Sheets

FLASHLIGHT ZOOMING STRUCTURE

BACKGROUND OF THE INVENTION

1. Technical Field

The present invention relates to a flashlight zooming structure. More particularly, the present invention relates to a flashlight zooming structure whereby a flashlight can project light to a distant or nearby target through adjustment of a zooming assembly provided at one end of a neck of the flashlight main body. By rotating the zooming assembly in the desired direction, the light emitted by a lighting unit at the end of the neck of the main body is projected outward through a transparent lamp cup in the zooming assembly either convergently or divergently to provide a clear view of the target.

2. Description of Related Art

A flashlight for illumination purposes typically includes a main body for receiving a battery pack and conductive components, a lighting unit provided at one end of a neck of the main body, and a cap screwed on the neck of the main body. To use the flashlight, a power switch provided on a lateral side or at one end of the main body is turned on, thereby driving the lighting unit to emit light for illuminating a target.

However, the lighting unit in such a flashlight usually has a single fixed focus, and, in most cases, the light emitted by the lighting unit can only be shed on a nearby target divergently. As the divergent light cannot reach a greater distance, the flashlight cannot be used to illuminate a distant target.

BRIEF SUMMARY OF THE INVENTION

The present invention provides an improvement over existing flashlights, and, particularly, in terms of the capability to illuminate targets at different distances. It is desirable that a flashlight can project light to a faraway or nearby target through adjustment of a zooming assembly provided at one end of a neck of the flashlight main body, and that by manually rotating a cap in the zooming assembly, a transparent lamp cup received in a cup seat is moved forward or backward to increase or decrease the distance between the lamp cup and a lighting unit at the end of the neck of the flashlight main body, thus allowing the light emitted by the lighting unit to project outward through the lamp cup as a convergent or divergent light beam. In short, it is desirable that a flashlight can be flexibly adjusted to project light to different distances.

The primary object of the present invention is to provide a flashlight which includes a main body and a zooming assembly. The zooming assembly is threadedly connected to one end of a neck of the main body and includes a cap, a cup seat, a lamp cup, and a middle annular element. The cap has a predetermined inner section formed as a threaded section. The open end of the cap is peripherally provided with a plurality of inwardly extending projections. The cup seat has an outer periphery provided with at least two lugs, and each lug has an outer side formed as a threaded portion threadedly connected with the threaded section of the cap. The inner periphery of the cup seat tapers downward and therefore defines a relatively large opening and a relatively small opening at opposite ends. The relatively large opening of the cup seat is peripherally provided with a plurality of spaced and inwardly extending fasteners. The lamp cup is transparent, centrally formed with a convex lens, received in the cup seat, and thus limited in position by the fasteners of the cup seat. The middle annular element has one end extended with a receiving section, and the receiving section is peripherally provided with notches having a predetermined depth. The lugs on the outer periphery of the cup seat are respectively inserted into the notches and can be displaced therein. The inner periphery of the middle annular element is formed with threads threadedly connected with an externally threaded portion of the neck of the main body. In addition, the opposite end of the middle annular element is concavely provided with an annular groove with which the projections of the cap are engaged to limit the middle annular element and the cap in position. To operate the zooming assembly mounted at one end of the flashlight, the cap is rotated as appropriate so that the cup seat in the zooming assembly is displaced upward or downward along the corresponding notches of the middle annular element. In consequence, the lamp cup received in the cup seat is moved forward or backward along with the cup seat, and the light emitted by a lighting unit at the end of the neck of the main body is projected outward through the transparent lamp cup in the zooming assembly to achieve the desired light converging or diverging effect. The aforesaid zooming adjustment can be flexibly made.

The second object of the present invention is to provide the foregoing flashlight, with the convex lens of the transparent lamp cup being convex outward, and with the lamp cup further having a lower end provided with a concave region. The light emitted by the lighting unit at the end of the neck of the main body is guided by the concave region and projected outward through the convex lens to achieve the desired light converging or diverging effect.

BRIEF DESCRIPTION OF THE SEVERAL VIEWS OF THE DRAWINGS

The structure as well as a preferred mode of use, further objects, and advantages of the present invention will be best understood by referring to the following detailed description of an illustrative embodiment in conjunction with the accompanying drawings, in which.

DETAILED DESCRIPTION OF THE INVENTION

Figure 1:
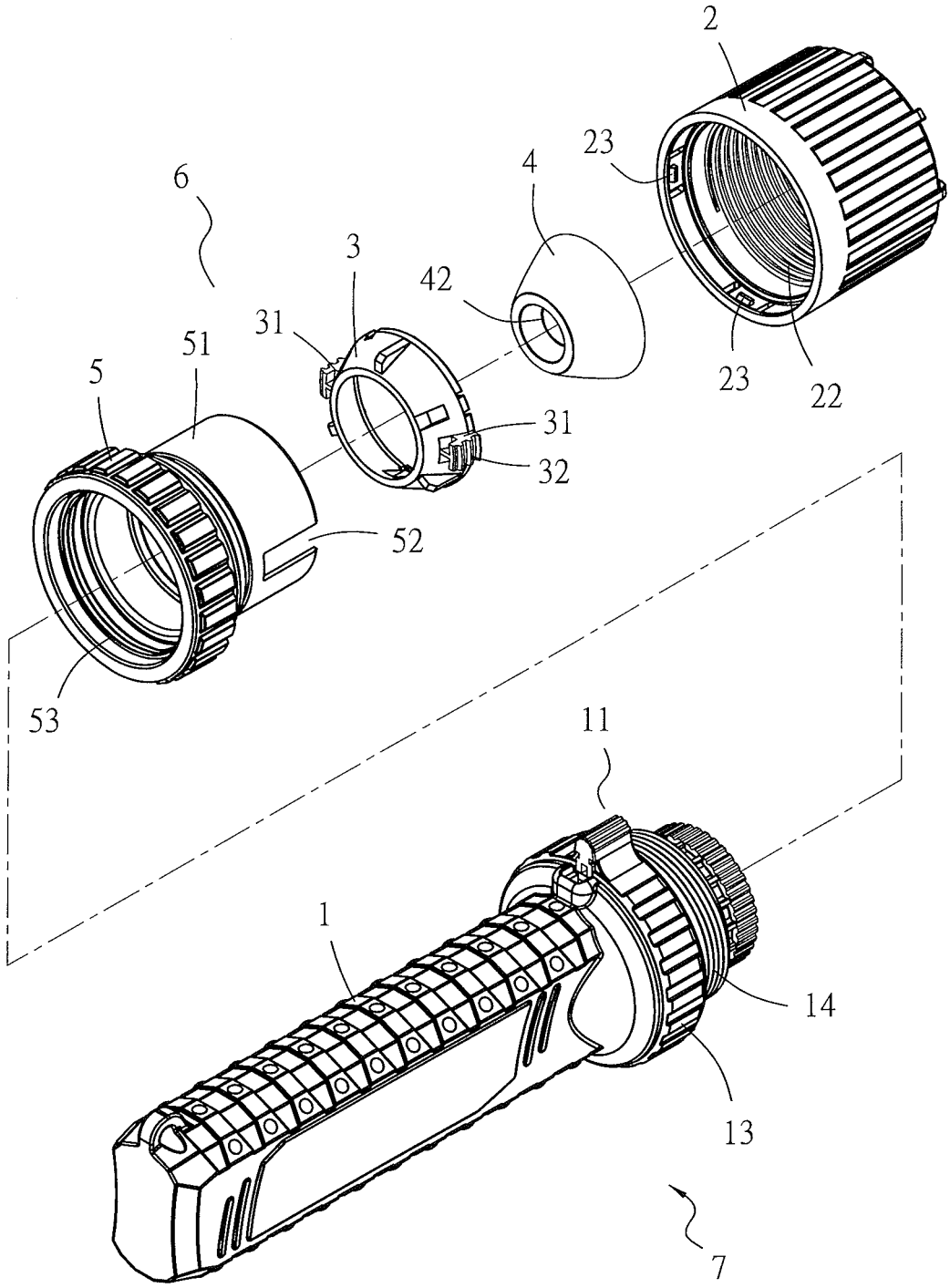
FIG. 1 is an exploded perspective view of a flashlight according to an embodiment of the present invention.
Figure 2:
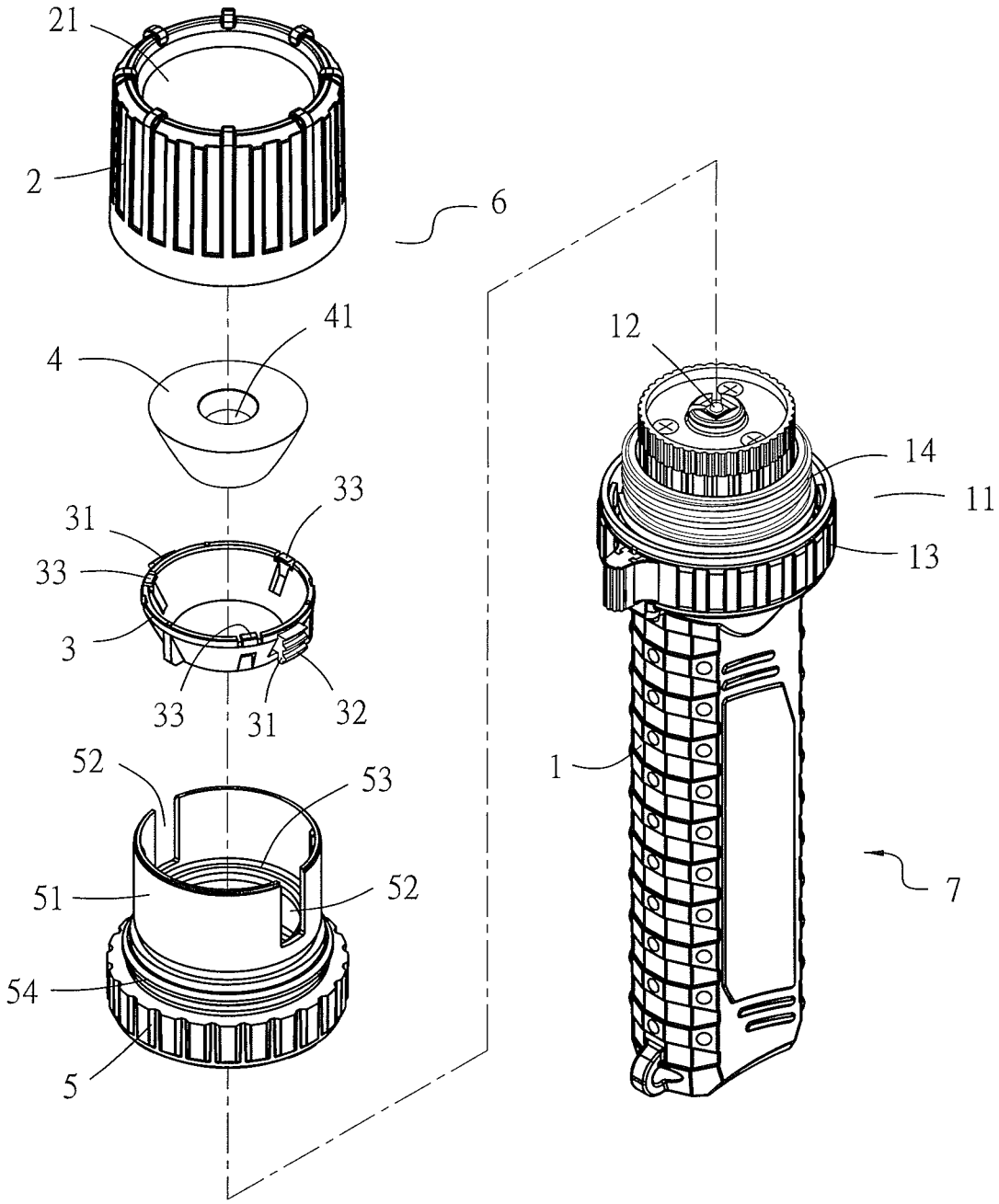
FIG. 2 is another exploded perspective view of the flashlight depicted in FIG. 1.

Please refer to FIGS. 1 and 2 for a flashlight zooming structure according to an embodiment of the present invention. As shown in the drawings, a flashlight 7 includes a main body 1 and a zooming assembly 6. The zooming assembly 6 is threadedly connected to one end of the neck 11 of the main body 1 and includes a cap 2, a cup seat 3, a lamp cup 4, and a middle annular element 5.

The main body 1 is a flashlight main body in which a battery pack and conductive components are received. The upper end of the main body 1 is defined as the neck 11, and the upper end of the neck 11 is connected with a lighting unit 12 (implemented herein by a light-emitting diode). A lower annular element 13 is mounted around a lower section of the neck 11 of the main body 1 so that, by rotating the lower annular element 13, a power switch connected thereto is driven to switch between different lighting modes such as a turned on mode, a flashing mode, and a turned off mode. (The power switch is not a major technical feature of the present invention and therefore will not be dealt with in further detail herein.) In addition, the upper end of the neck 11 of the main body 1 has an externally threaded portion 14.

Figure 5:
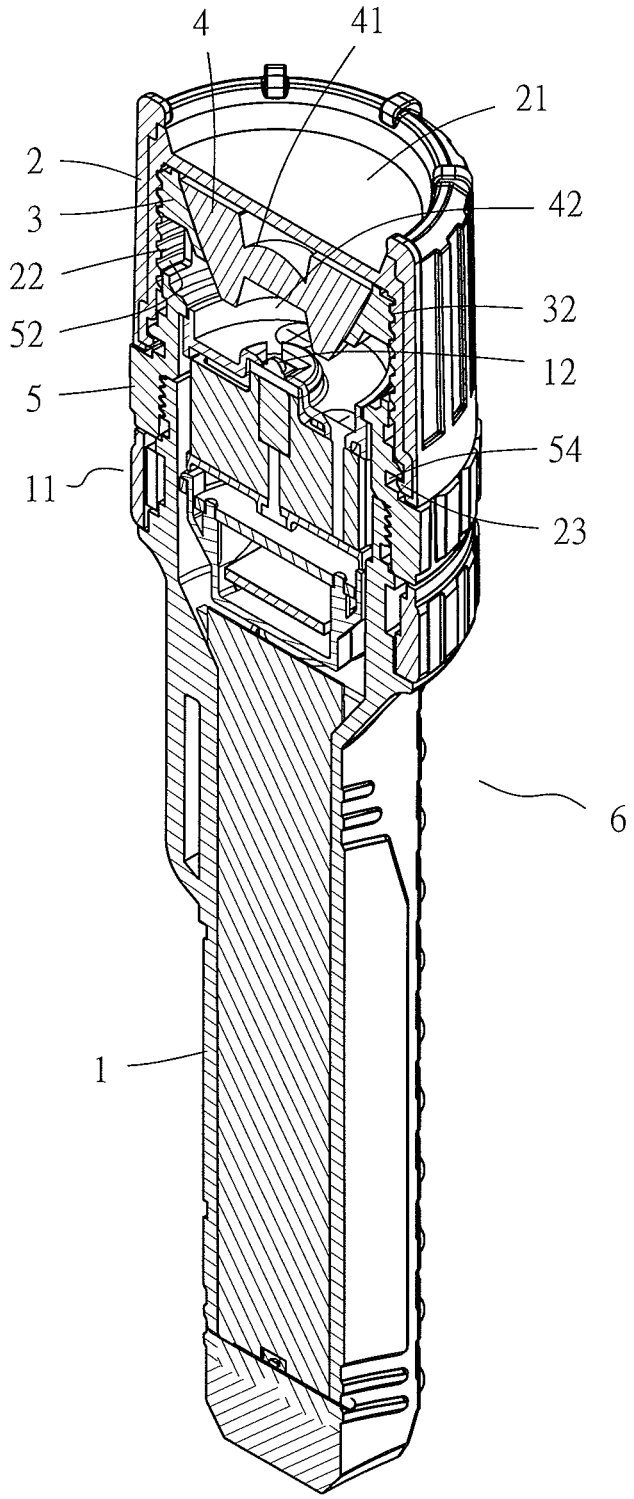
FIG. 5 is a sectional view taken along the line 50-50 of FIG. 4.

The cap 2 is a component connected with a transparent cover 21 at one end. A predetermined inner section of the cap 2 is formed as a threaded section 22, as shown in FIG. 1. The open end of the cap 2 is peripherally provided with a plurality of inwardly extending projections 23, as shown in FIG. 5.

The cup seat 3 is a movable component shaped according to the interior space of the cap 2. The outer periphery of the cup seat 3 is provided with at least two lugs 31, and each lug 31 has a threaded portion 32 on the outer side. As shown in FIG. 2, the inner periphery of the cup seat 3 tapers toward the lower end and thus defines a relatively large opening and a relatively small opening. The relatively large opening of the cup seat 3 is peripherally provided with, a plurality of spaced and inwardly extending fasteners 33.

The lamp cup 4 is a transparent component shaped according to the inner periphery of the cup seat 3. As shown in FIGS. 1, 2 and 5, the lamp cup 4 is centrally formed with a convex lens 41 which is convex toward the outside, and a concave region 42 is formed at the lower end of lamp cup 4.

The middle annular element 5 is a covering component shaped according to the main body 1 and the cup seat 3. A receiving section 51 extends from one end of the middle annular element 5 and is peripherally provided with notches 52 of a predetermined depth. The inner periphery of the middle annular element 5 is formed with threads 53. The other end of the middle annular element 5 is concavely provided with an annular groove 54, as shown in FIG. 5.

Figure 3:
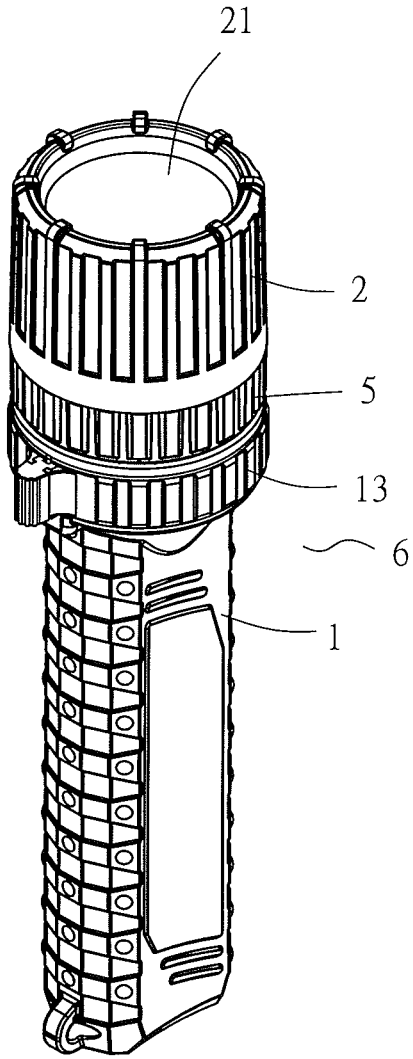
FIG. 3. is an assembled perspective view of the flashlight depicted in FIG. 1.
Figure 4:
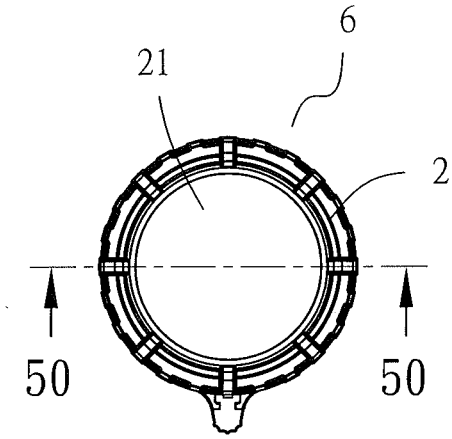
FIG. 4 is an assembled top view of the flashlight depicted in FIG. 1.

The main body 1, the cap 2, the cup seat 3, the lamp cup 4, and the middle annular element 5 are put together as follows. Referring to FIGS. 1, 2, and 5, the first step is to place the transparent lamp cup 4, which is centrally formed with the convex lens 41, into the cup seat 3 such that the lamp cup 4 is limited in position by the fasteners 33 provided along the periphery of one end of the cup seat 3. In the second step, the threaded portions 32 of the spaced lugs 31 on the outer periphery of the cup seat 3, which now receives the transparent lamp cup 4, are threadedly connected with the threaded section 22 of the cap 2. In the third step, the lugs 31 on the outer periphery of the cup seat 3, which was screwed into the cap 2 in the previous step, are inserted respectively into the peripheral notches 52 of the receiving section 51 at one end of the middle annular element 5, and the peripheral projections 23 at one end of the cap 2 are engaged with the annular groove 54 of the middle annular element 5, such that the cap 2 and the middle annular element 5 are limited in position relative to each other. Thus, the zooming assembly 6 is completed. In the fourth and last step, the threads 53 on the inner periphery of the middle annular element 5 in the zooming assembly 6 are threadedly connected with the externally threaded portion 14 of the neck 11 of the main body 1 to form the flashlight 7, as shown in FIGS. 3, 4, and 5.

Figure 6:
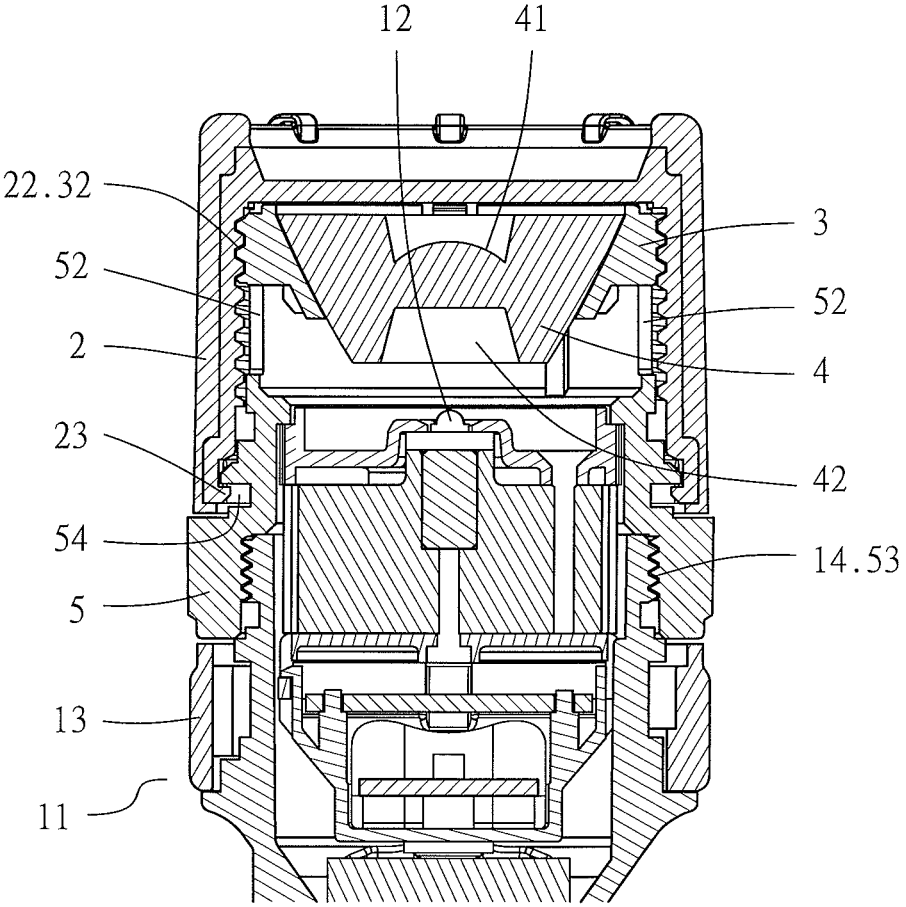
FIG. 6 is a sectional view showing how a zooming assembly of the flashlight depicted in FIG. 1 is adjusted to divert light.
Figure 7:
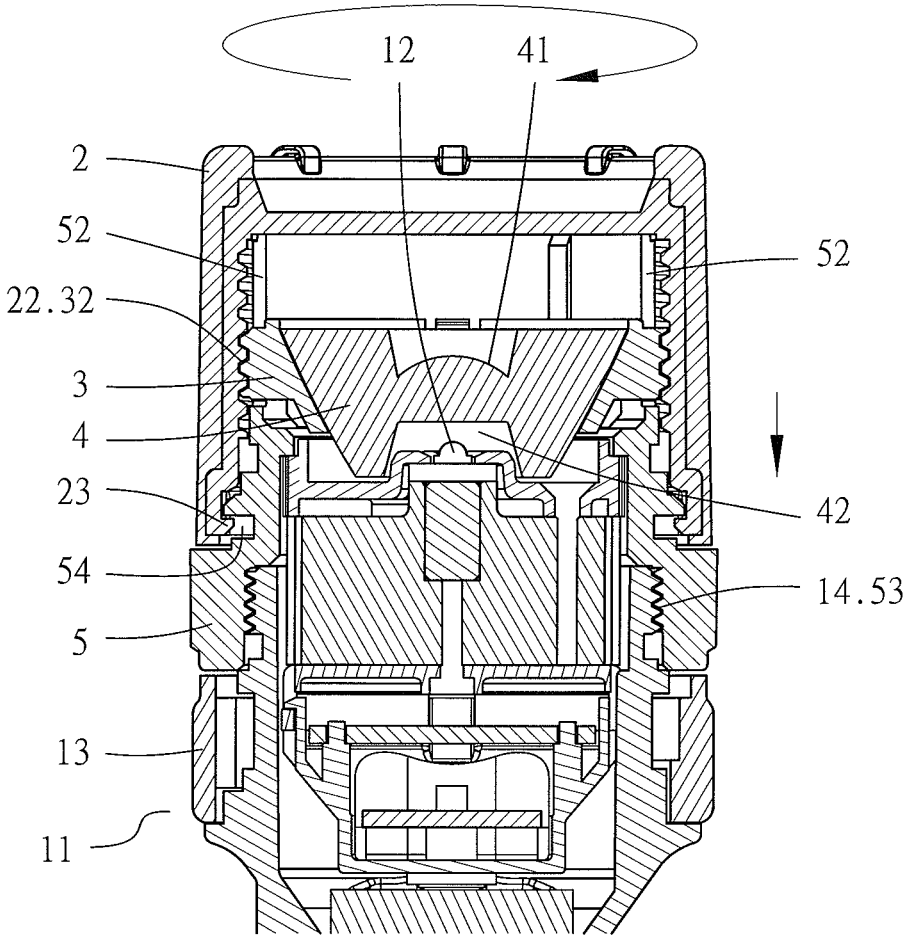
FIG. 7 is another sectional view showing how the zooming assembly of the flashlight depicted in FIG. 1 is adjusted to converge light.

To operate the zooming assembly 6 provided at one end of the neck 11 of the main body 1 of the flashlight 7, referring to FIGS. 6 and 7, the cap 2 is rotated in the desired direction (e.g., in a reverse direction if it is desired to diverge light, as shown in FIG. 6; or in a forward direction if it is desired to converge light, as shown in FIG. 7), so that the cup seat 3 inside the cap 2 is moved upward or downward along the notches 52 of the middle annular element 5. As the cup seat 3 is moved forward or backward, the lamp cup 4 received therein is moved along with the cup seat 3. Thus, the light emitted by the lighting unit 12 at one end of the neck 11 of the main body 1 is guided by the concave region 42 at one end of the transparent lamp cup 4 in the zooming assembly 6 and then projected outward through the convex lens 41 to produce the desired light diverging or converging effect. In a nutshell, the light diverging or converging effect can be achieved through flexible adjustment of the cap 2.

When it is desired to remove the zooming assembly 6 threadedly connected to one end of the neck 11 of the main body 1 of the flashlight 7, the user only has to rotate the middle annular element 5, and the zooming assembly 6 can be rapidly detached from the neck 11 of the flashlight main body 1.

Furthermore, by rotating the lower annular element 13, the flashlight 7 can be switched between predetermined lighting modes, such as a strong light mode, a weak light mode, a flashing mode, and a turned off mode.

What is claimed is:

1. A flashlight zooming structure, comprising a main body and a zooming assembly threadedly connected to an end of a neck of the main body, wherein the zooming assembly comprises a cap, a cup seat, a lamp cup, and a middle annular element, with the cap having a predetermined inner section formed as a threaded section, with the cap having an open end peripherally provided with a plurality of inwardly extending projections, with the cup seat having an outer periphery provided with at least two lugs, with each said lug having an outer side formed as a threaded portion threadedly connected with the threaded section of the cap, with the cup seat having a downwardly tapering inner periphery defining a first opening and a second opening, with the first opening being larger than the second opening, with the first opening peripherally provided with a plurality of spaced and inwardly extending fasteners, with the lamp cup being transparent and centrally formed with a convex lens, with the lamp cup received in the cup seat and limited in position by the fasteners of the cup seat, with the middle annular element having an end extended with a receiving section, with the receiving section peripherally provided with notches of a predetermined depth, with the lugs on the outer periphery of the cup seat inserted in and movable along the notches, with the middle annular element having an inner periphery provided with threads threadedly connected with an externally threaded portion of the neck of the main body, with the middle annular element having an opposite end concavely provided with an annular groove, and with the projections of the cap engaged with the annular groove to limit the cap and the middle annular element in position; and wherein the zooming assembly is operated by rotating the cap in a desired direction so that the cup seat in the zooming assembly is moved upward or downward along the notches and the lamp cup received in the cup seat is moved along with the cup seat, thus allowing light emitted by a lighting unit at the end of the neck of the main body to project outward through the transparent lamp cup in the zooming assembly as a divergent or convergent light beam.

2. The flashlight zooming structure of claim 1, wherein the convex lens of the transparent lamp cup is outwardly convex, and wherein the lamp cup has a lower end provided with a concave region, with the light emitted by the lighting unit at the end of the neck of the main body guided by the concave region and projected outward through the convex lens as the divergent or convergent light beam.

* * * * *